United States Patent [19]

Barclay

[11] 4,045,964

[45] Sept. 6, 1977

[54] SUBTERRANEAN PANEL DRAIN

[76] Inventor: James A. Barclay, 82 Buena Vista Drive, Dobbs Ferry, N.Y. 10522

[21] Appl. No.: 640,848

[22] Filed: Dec. 15, 1975

[51] Int. Cl.[2] ..... E02B 11/00; E02D 31/02

[52] U.S. Cl. ..... 61/11; 52/169.5

[58] Field of Search ..... 61/10, 11, 12, 13; 52/169; 210/346, 486

[56] References Cited

U.S. PATENT DOCUMENTS

| | | | |
|---|---|---|---|
| 2,152,619 | 3/1939 | Maher | 61/11 X |
| 3,563,038 | 2/1971 | Healy et al. | 61/11 |
| 3,611,729 | 10/1971 | Stark | 61/10 |
| 3,654,765 | 4/1972 | Healy et al. | 61/11 |
| 3,888,087 | 6/1975 | Bergsland | 61/11 |

*Primary Examiner*—Paul R. Gilliam
*Assistant Examiner*—David H. Corbin
*Attorney, Agent, or Firm*—S. Michael Bender

[57] ABSTRACT

A subterranean panel drain is provided comprising a unitary prefabricated panel having a serpentine shaped transverse cross-section defining a series of substantially vertically arrayed corrugations. A plurality of spaced slots is provided in each alternately arrayed corrugation with the slots preferably being disposed at an angle to a horizontal plane passing through the panel. In one preferred embodiment, the subterranean panel drain may be employed in abutting relation against a foundation wall to form a conduit between moisture in the soil adjacent the foundation and a conventional drain pipe at the base of the foundation. In another preferred embodiment, a pair of subterranean panel drains may be placed in back-to-back relation to form a curtain drain for transferring collected moisture in soil to a drainage pipe.

10 Claims, 5 Drawing Figures

SUBTERRANEAN PANEL DRAIN

The present invention generally relates to method and means for removing water from soil and more specifically, to a novel subterranean panel drain for removing water collecting in the vicinity of building foundations, or structural retaining walls, or for removing water tending to collect and form wet spots in the open field.

As is well appreciated in the art, it is common to facilitate the removal of water from say, backfilled soil in the vicinity of a building or structural foundation, by draining off the water through a subterranean drain pipe disposed in a bed of aggregate gravel at the base of the foudation footing. Frequently however, such systems are ineffective in completely preventing water from entering the basement interior of the building due to such factors as improper design or installation, clogging of the drain pipe or the surrounding aggregate bed, or the appearance of cracks or other defects in the subterranean foundation walls after the drainage system has been installed. Accordingly, it has been proposed to improve conventional drainage systems by employing a more efficient means for quickly removing water from the soil surrounding a subterranean foundation wall. For example, in U.S. Pat. No. 3,654,765 there is disclosed a subterranean wall drain comprising a planar core having a series of corrugated channels therein integrally connected to a generally horizontally disposed drainage pipe. The wall drain is placed adjacent the foundation wall and the corrugated channels in the core are vertically arranged so as to empty water flowing along the channels into the drain pipe. In order to prevent soil particles from entering and clogging the vertically disposed corrugated channels or the integrally connected drain pipe an outer sheet of pervious material is affixed to the side of the corrugated panel facing away from the foundation wall. In addition, another sheet of vapor impervious material is affixed to the other or inwardly facing side of the corrugated panel. This sandwiched construction thus requires the assembly of several parts leading to increased cost. Furthermore, it is possible for the pervious outer sheet to eventually become detached from the corrugated panel member thus permitting soil to enter and clog the corrugated channels. Moreover, since only the corrugated channels facing outwardly from the foundation wall are utilized to carry water, the capacity of the panel is less than is otherwise desired.

Therefore, against the foregoing background it is a primary objective of the present invention to provide an improved subterranean panel drain.

It is another objective of the present invention to provide an improved subterranean panel drain comprising a unitary prefabricated panel member.

It is yet another objective of the present invention to provide a subterranean panel drain which is less expensive to fabricate and install than prior art panel drains.

It is still another objective of the present invention to provide an improved system for facilitating the rapid drainage of water from the vicinity of subterranean foundation walls or from wet spots formed of collected water in the open field.

Briefly summarized, the present invention contemplates a subterranean panel drain comprising a unitary prefabricated panel having a serpentine shaped tranverse cross-section defining a series of substantially vertically arrayed corrugations. A plurality of spaced openings or slots is provided in alternately arrayed corrugations with the slots preferably being disposed at an angle to a horizontal plane passing through the panel. In one preferred embodiment, the subterranean panel drain may be employed in abutting relation against a foundation wall to form a conduit between moisture in the soil adjacent the foundation and a conventional drain pipe at the base of the foundation. In another preferred embodiment, a pair of subterranean panel drains may be placed in back-to-back relation to form a curtain drain for transferring collected moisture in soil to a drainage pipe.

Additional objects and advantages as well as a more complete understanding of the invention will be made more apparent from a study of the following detailed description thereof in connection with the accompanying drawings wherein:

FIG. 1 is a prospective view depicting a fragmentary portion of the subterranean panel drain according to the present invention;

FIG. 2 schematically shows the panel of FIG. 1 in vertical cross-section adjacent the foundation wall of a building structure;

Figure 1:
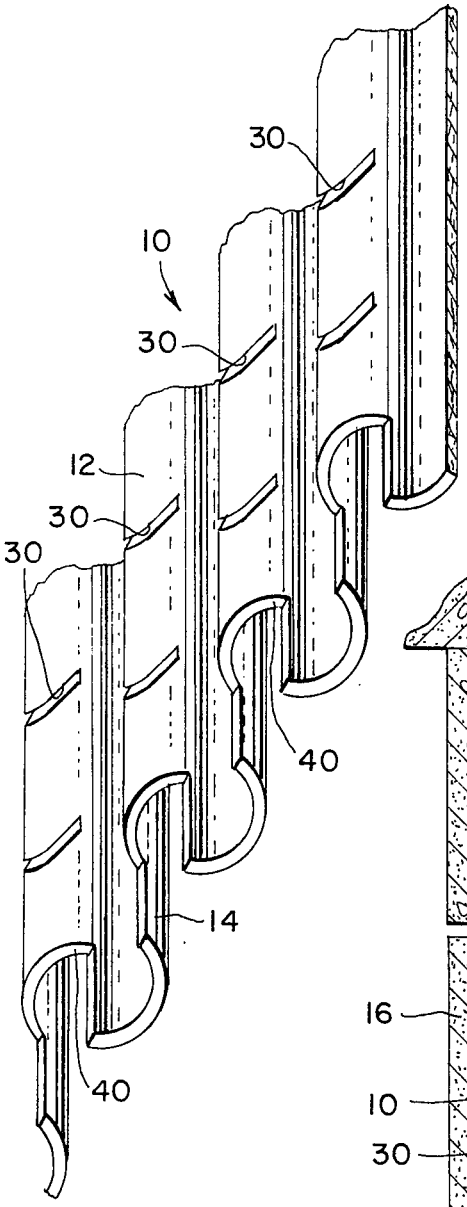
Figure 2:
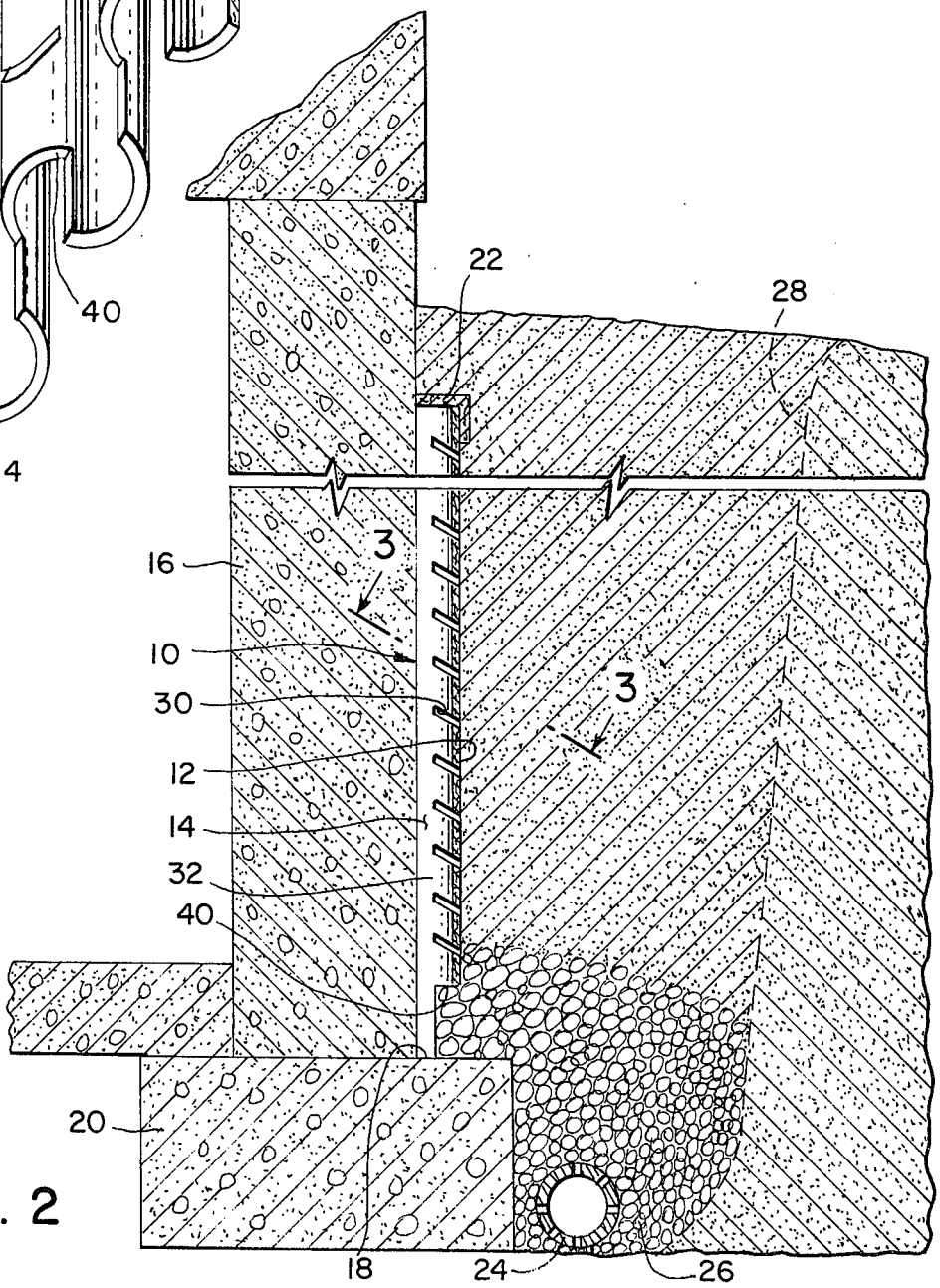
Figure 3:
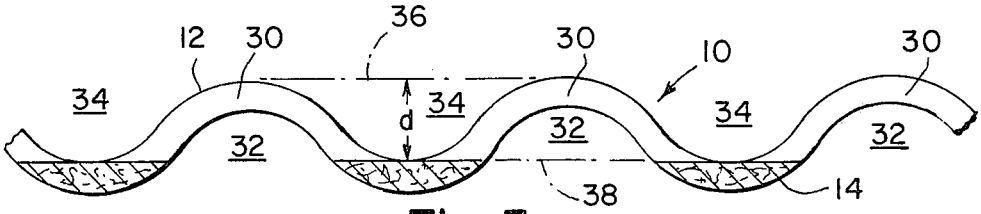
FIG. 3 is a sectional view of a portion of the subterranean panel drain taken along line 3—3 in FIG. 2.

Turning now to FIGS. 1-3, there is shown a first preferred embodiment of the present invention comprising a subterranean panel drain member generally represented by reference numeral 10. Panel drain member 10 is formed from a sheet of corrugated material such that in horizontal transverse cross-section the member has a serpentine shape defining alternating ridges and valleys across the front side 12 and back side 14 of the member, respectively, as best seen in FIGS. 1 and 3. In use, the panel drain member 10 is placed adjacent the foundation wall 16 of a building or other structure with the channels formed by the corrugations in the member extending vertically from the upper surface 18 of foundation footing 20 and with the longitudinally extending apex of each alternate ridge on back side 14 in abutting contact with the foundation wall. As substantially shown in FIG. 2, the panel drain member includes suitable means for sealing the upper ends of the channels formed by the corrugations on the back side 14 thereof such as a cap member 22 affixed to the panel member by suitable means such as an adhesive, for example. It will be appreciated that prior to placement of the panel drain member in this position, the wall may have been prepared in the usual manner by applying thereto a coat of cement plaster followed by an outer vapor impervious bituminous coating (not shown). A conventional perforated drainage pipe 24 is placed adjacent the base of foundation footing 20 within the usual bed of gravel aggregate or crushed stone 26. Care should be taken however, to insure that the bed of gravel extends above the lower portion of the panel drain member 10 as indicated in FIG. 2. When the panel drain member 10 or a juxtaposed plurality of such members have been so installed, the excavation surrounding the foundation (indicated by broken line 28 in FIG. 2) may be backfilled with suitable earth in the usual manner.

Panel drain member 10 may be fabricated from any suitable material capable of being formed in the desired corrugated or serpentine shape and which is impervious to water, capable of withstanding corrosion or degradation for long periods in a subterranean environment, and is of sufficient strength to maintain its shape and dimensional stability under hydraulic or soil loading. An example of a commercially obtainable material especially suitable for the present invention, is a mineral fibre and cement composition marketed in the form of prefabricated corrugated panels by Johns-Manville Corporation under the trademark Transite. A typical corrugated panel of such material has a height of 12 feet, a width of 42 inches, an average thickness of three-eighths inches, includes ten corrugations spaced approximately 4.2 inches apart, and has a width between ridges on front and back sides of approximately 1.5 inches.

An important feature of the present invention resides in the provision of a plurality of spaced slots or openings 30 in the ridges or corrugations on the side of the panel member extending outwardly with respect to the foundation wall namely, side 12. For purposes which will be explained below, the slots 30 preferably are inclined with reference to a horizontal plane at an angle within the range from about 10° to about 45° with an angle of about 30° being particularly preferred. The slots permit the passage of water from the soil adjacent the panel member into the channels 32 formed by the corrugations on the back side 14 of the panel member whereupon the water flows downwardly along channels 32 emptying into the gravel bed 26 and thence into the perforated drain pipe 24 located at the base of the foundation footing 20. Likewise, water can also flow albeit to a lesser degree vertically downwardly along the channels or valleys 34 formed by the corrugations on the front side 12 of the panel member, wherefore, the corrugated channels on both sides of the panel member may be advantageously utilized to direct water to the gravel bed 26 and the perforated drain pipe 24, thereby increasing the drainage capacity of the panel drain of the present invention over that of prior sandwiched type corrugated panels used for similar purposes.

Generally speaking the arcuate shaped slots are of sufficient width and depth to permit water to enter the channels 32 on the back side 14 of the panel member without permitting significant amounts of soil particles entering the channels and clogging same. In this regard, it has been found that the effective size of each arcuate shaped slot 30 may be made larger thereby permitting greater quantities of water to enter the channels 32 on the back side 14 of the panel member without increasing the amount of soil entering these channels by inclining the plane of the slot with respect to a horizontal plane as described above. Stated otherwise, when employing inclined slots as disclosed herein, it is possible for a given slot width to increase the depth of each arcuate slot with respect to the ridge to ridge thickness of the panel. Thus, as substantially shown in FIG. 3, inclined arcuate shaped slots 30 may have a depth indicated by the letter *d* determined by the distance between a line 36 tangent to the apex of adjacent corrugations or ridges on the front side 12 of the panel member and a line 38 tangent to the nadir of the valley between said adjacent corrugations or ridges on the front side 12 of the panel member, said distance or depth *d* being measured in a plane passing through the panel member at the angle of inclination of the slots 30.

By employing slots 30 which are inclined as described above, a further advantage is realized in that such inclination tends to concentrate the flow of water within those portions of the channels 32 on the back side 14 of the panel member which are most outwardly disposed with respect to the adjacent foundation wall, thus tending to prevent the water from contacting the foundation wall as the water is directed downwardly along the channels and outwardly through the bottom of the panel member away from the foundation.

It has been found that arcuate shaped slots angled at the preferred angle of approximately 30° with respect to the horizontal may have a width (vertical height) with reference to FIG. 2 ranging from 0.05 inches to about 0.125 inches. Furthermore, it has been found that the number of such slots is not critical, and accordingly the vertical spacing between adjacent slots in each corrugation may vary depending upon the porosity of the surrounding soil and the anticipated moisture conditions to be encountered. Exemplary vertical spacing between slots may range from about 1 inch to about 5 inches depending upon the thickness of the panel member. That is, for thinner panel members vertical spacing should be greater whereas for thicker panels vertical spacing between adjacent slots may be decreased inasmuch too many slots spaced too closely together may reduce the strength or bearing resistance of the panel. It will be appreciated further that the slots in alternate adjacent corrugations may be staggered with respect to each other.

As shown in FIGS. 1 and 3, the bottom portion of each ridge formed by the corrugations on the front side 12 of the panel member 10 is preferably cut away to form notched openings 40 in the bottom of the panel member. The notched openings 40 facilitate the flow of water from the channels 32 on the back side 14 of the panel member into the gravel bed 26 and thus help to avoid backup of water within the channels, and furthermore aid in permitting any soil particles which may enter the channels 32 to empty out in a dispersed manner in the gravel bed thereby reducing the tendency of such particles to clog the gravel bed.

In forming the panel drain member of the present invention, the slots or openings 30 may be formed in the corrugated panel member in any convenient manner as by cutting the slots to the correct depth with a beveled saw blade although several passes of the blade might be necessary if the slot width is greater than the thickness of the saw blade. The notched openings 40 in the bottom of the panel member may be similarly formed in the panel drain member.

Figure 4:
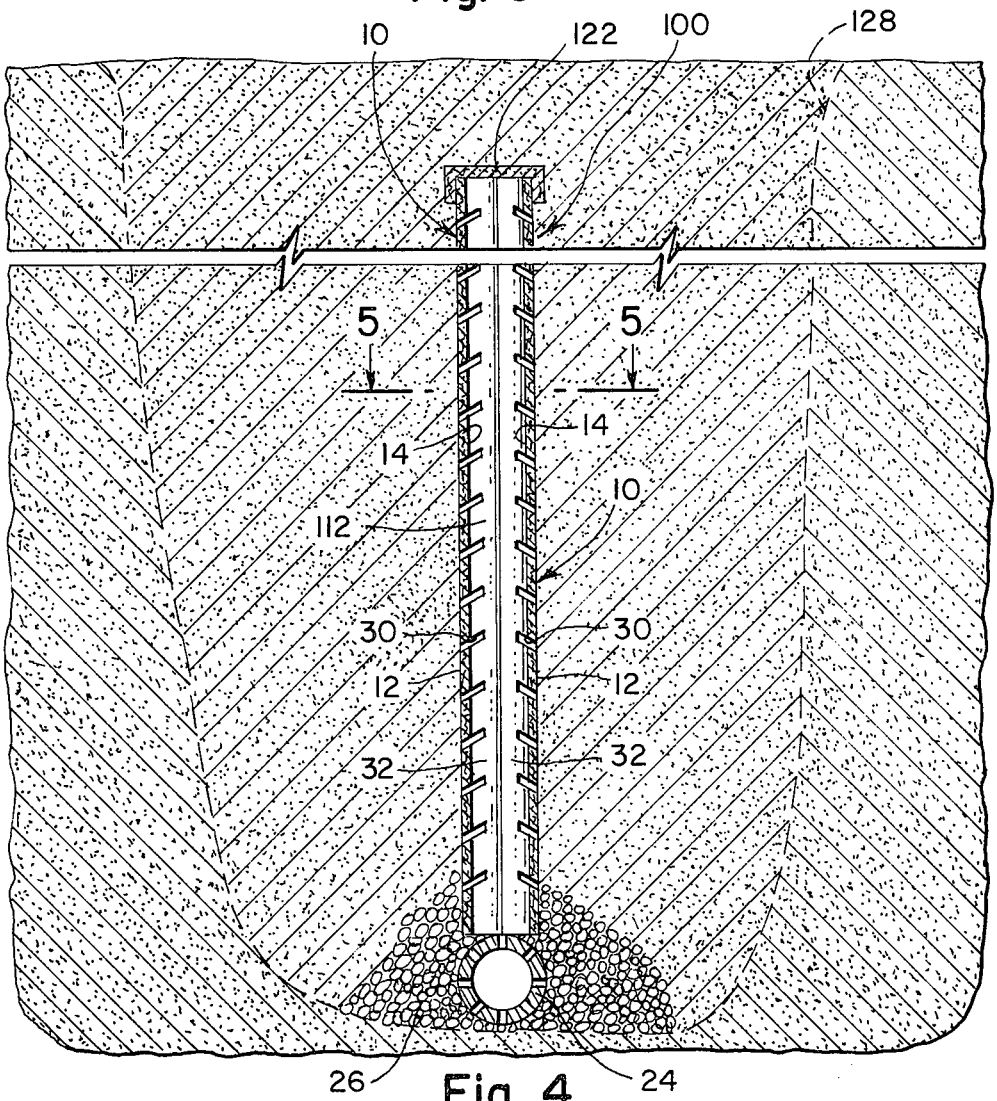
FIG. 4 illustrates an alternatively preferred embodiment of the present invention, namely, a curtain drain shown in vertical cross-section installed in the open field; and, FIG. 5 is a sectional view of a portion of the curtain drain taken along line 5—5 in FIG. 4.
Figure 5:
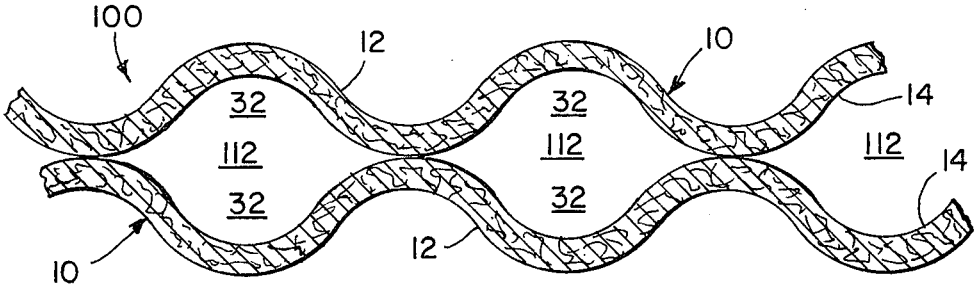

Turning now to FIGS. 4 and 5 wherein the same reference numerals are employed to represent the same or similar parts, there is shown an alternate preferred embodiment of the present invention in the form of a curtain drain 100 comprising a pair of panel drain members 10 as described above in connection with FIGS. 1–3 disposed in a back-to-back configuration such that the channels 32 on the rear side of each panel member are in diametrically opposed registration and the apexes of each ridge on the rear side of each panel are in corresponding longitudinal abuttment. As a result of this arrangement there is provided interiorly of the curtain drain, a plurality of substantially vertically disposed, parallel, spaced channels 112 as best seen in FIG. 5. As further indicated in FIG. 4, each ridge or corrugation on the side of each panel member facing outwardly includes the plurality of spaced slots 30 each of which may be and is preferably inclined as described above in connection with the embodiment of FIGS. 1-3.

The two panel members 10 are fastened together in the arrangement of FIGS. 4 and 5 to form the curtain drain 100 in any convenient manner as by applying a suitable adhesive to the abutting portions thereof, or by employing suitable fastening means such as clips, rivets, pins, etc. A cap member 122 is employed to seal the upper ends of the channels 112 and to aid in maintaining the two panel members 10 in their desired back-to-back arrangement, the cap member preferably being affixed to the curtain drain along the upper edges of the panel members as shown in FIG. 4 by a suitable adhesive although other fastening means may be used instead.

The curtain drain of FIGS. 4 and 5 is especially suitable for subterranean installation in the open field where it is desirable to provide means for preventing the collection of water and the recurring formation of wet spots. Thus, in installation, the area in the open field to be drained is excavated to form a trench (indicated by broken line 128, FIG. 4) and the usual perforated drainage pipe 24 is placed in the bottom of the trench. The curtain drain is then placed within the trench with its bottom edge preferably in direct abutting contact along the upper surface of the drain pipe and in longitudinal alignment therewith as substantially shown in FIG. 4. The usual gravel aggregate may then be placed in the bottom of the trench surrounding the drainage pipe and the lower portion of the curtain drain. Finally, the excavated trench may be backfilled to maintain the subterranean curtain drain in its desired position as schematically illustrated in FIG. 4.

It is apparent that where water formerly tended to collect in the region of the excavated trench forming a wet spot, such water is now able to flow through the slots 30 in either outwardly facing side of the curtain drain 100 and be carried downwardly along channels 112 into and through the drainage pipe 24.

Although several preferred embodiments of the present invention have been described above in detail as required by statute many variations and modifications thereof may be made by those skilled in the art without departing from the principles of the invention. Accordingly, the present invention should be limited only by the true scope of the appended claims.

What is claimed is:

1. A subterranean panel drain comprising a unitary member having a top edge, a bottom edge, and first and second sides, said unitary member having a transverse cross-section defining a plurality of alternately disposed ridges and valleys on said first side and said second side respectively, the ridges on said first side corresponding to the valleys on said second side and the ridges on said second side corresponding to the valleys on said first side, said valleys defining a plurality of substantially vertically disposed fluid-flow channels extending between said top edge and said bottom edge, and a plurality of openings disposed in said ridges on said first side to communicate with the corresponding channels on said second side, said openings being inclined upwardly from said first side to said second side, said unitary member being adapted for subterranean installation whereby water in soil adjacent said first side is capable of flowing through said openings, entering said corresponding channels on said second side, and being directed along said corresponding channels toward said bottom edge of said member.

2. The invention of claim 1 wherein said openings are slots formed by a planar cut passing through said ridges at an angle inclined upwardly from said first side to said second side, said angle being measured between the plane of said cut and a transverse horizontal plane passing through said member, said angle being in the range of about 10° to about 45°.

3. The invention of claim 2 wherein said angle is about 30°.

4. The invention of claim 2 wherein the depth of said planar cut is equal to the distance between a line tangent to the apexes of adjacent ridges on said first side and a line tangent to the nadir of the valley between said adjacent ridges on said first side.

5. The invention of claim 1 wherein said transverse cross-section of said unitary member is serpentine shaped.

6. The invention of claim 1 wherein said bottom edge of said unitary member includes a plurality of spaced notches disposed therein.

7. The invention of claim 1 further including cap means for sealing the top edge of said unitary member.

8. The invention of claim 1 comprising a pair of said unitary members disposed in a juxtaposed manner with the alternately disposed ridges on said first side of each of said pair of unitary members being in abutting contact with each other respectively, said pair of unitary members defining a subterranean curtain drain.

9. The invention of claim 8 further including cap means for sealing the top edges of said pair of juxtaposed unitary members.

10. A self-draining structure comprising:

a. a foundation wall having a footing;

b. a subterranean panel drain comprising a unitary member having a top edge, a bottom edge, and first and second sides, said unitary member having a transverse cross-section defining a plurality of alternately disposed ridges and valleys on said first side and said second side respectively, the ridges on said first side corresponding to the valleys on said second side and the ridges on said second side corresponding to the valleys on said first side, said valleys defining a plurality of substantially vertically disposed fluid-flow channels extending between said top edge and said bottom edge, and a plurality of openings disposed in said ridges on said first side to communicate with the corresponding channels on said second side;

c. said unitary member bottom edge being disposed on said foundation wall footing such that the ridges on said second side of said member are in abutting contact with said foundation wall; and d. back-fill soil disposed adjacent said first side of said member whereby moisture in said back-fill soil adjacent said first side is capable of flowing through said openings, entering said corresponding channels on said second side, and being directed along said corresponding channels toward said bottom edge of said member.

* * * * *